United States Patent [19]

Kortenhaus et al.

[11] 3,985,217

[45] Oct. 12, 1976

[54] CONTROL SYSTEM FOR A COIN-OPERATED MUSICAL MACHINE

[75] Inventors: Dieter Kortenhaus; Jürgen P. Busch, both of Bingen, Germany

[73] Assignee: NSM Apparatebau GmbH Kommanditgesellschaft, Bingen, Germany

[22] Filed: Aug. 11, 1975

[21] Appl. No.: 603,762

[30] Foreign Application Priority Data

Aug. 19, 1974 Germany ..... 2439675

[52] U.S. Cl. ..... 194/15; 340/162

[51] Int. Cl.[2] ..... G07F 17/00

[58] Field of Search ..... 194/15; 274/10 R; 340/162

[56] References Cited

UNITED STATES PATENTS

| | | | |
|---|---|---|---|
| 3,555,509 | 1/1971 | Arsem | 340/162 |
| 3,701,970 | 10/1972 | Jachimek et al. | 194/15 |
| 3,718,906 | 2/1973 | Lightner | 194/15 |

*Primary Examiner*—Stanley H. Tollberg
*Attorney, Agent, or Firm*—Max Fogiel

[57] ABSTRACT

A control system for the selection and storage of each phonograph record side to be played in a coin-operated juke box having a storage and credit mechanism. A microcomputer operating as a process computer has a number of inputs and outputs limited to a minimum by series-type runs. The microcomputer has a central computer unit, a set-value storage, and a write/read storage with selective access. The microcomputer unit, furthermore, is coupled with a clock or timing generator connected to a BCD for 1 out of 10 decoder, to a BCD for 7-segment decoder, to a BCD for 1 out of 16 decoder, and via these decoders to level converters with series-connected output units and input circuits in the form of a coding table, keyboard, input switch and coin switch.

6 Claims, 8 Drawing Figures

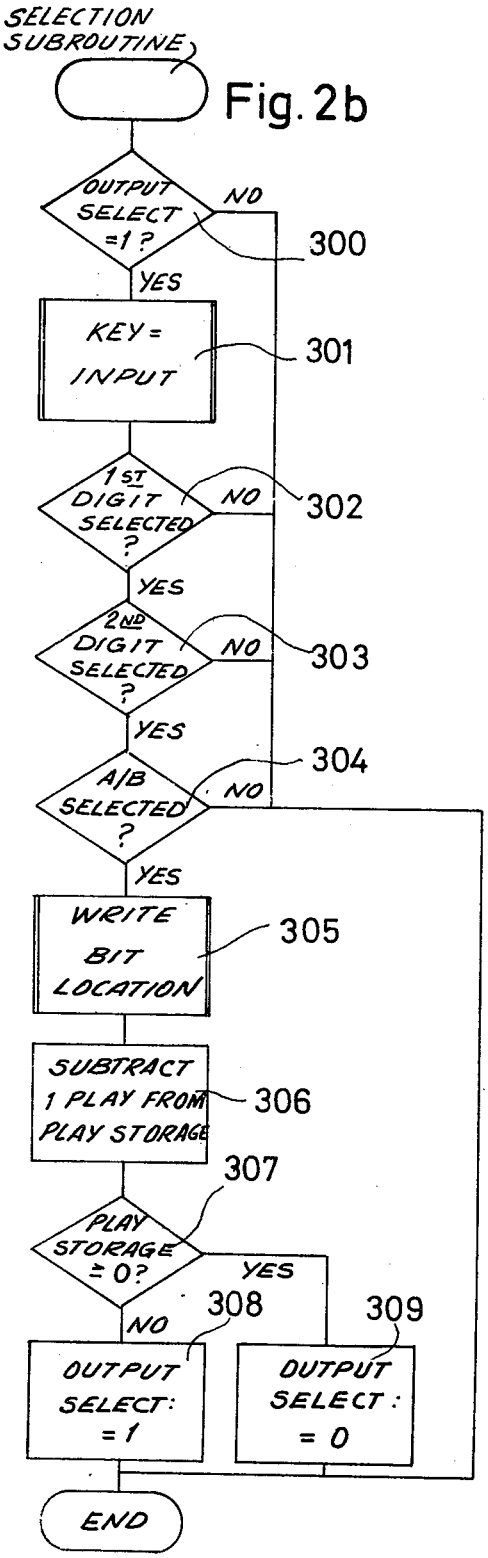
SELECTION SUBROUTINE
Fig. 2b
OUTPUT SELECT =1 ?
NO
300
YES
KEY = INPUT
301
1ST DIGIT SELECTED ?
NO
302
YES
2ND DIGIT SELECTED ?
NO
303
YES
A/B SELECTED ?
NO
304
YES
WRITE BIT LOCATION
305
SUBTRACT 1 PLAY FROM PLAY STORAGE
306
307
PLAY STORAGE ≥ 0?
YES
NO
308
309
OUTPUT SELECT: = 1
OUTPUT SELECT : = 0
END

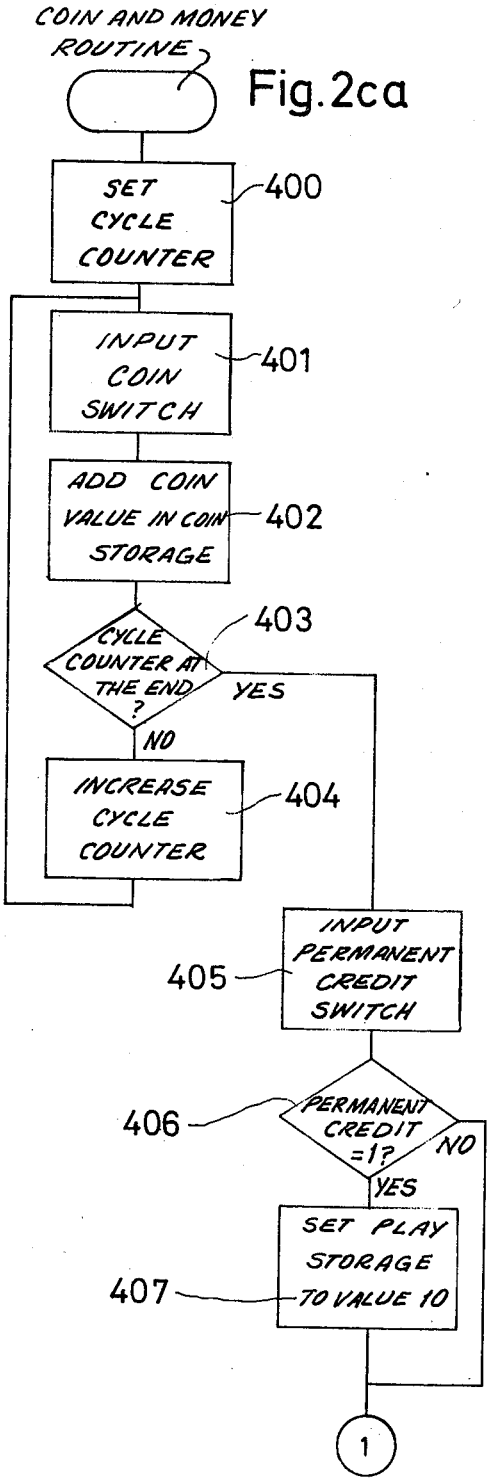
COIN AND MONEY ROUTINE
Fig. 2ca
SET CYCLE COUNTER
400
INPUT COIN SWITCH
401
ADD COIN VALUE IN COIN STORAGE
402
403
CYCLE COUNTER AT THE END ?
YES
NO
INCREASE CYCLE COUNTER
404
INPUT PERMANENT CREDIT SWITCH
405
406
PERMANENT CREDIT =1?
NO
YES
SET PLAY STORAGE TO VALUE 10
407
1

CONTROL SYSTEM FOR A COIN-OPERATED MUSICAL MACHINE

BACKGROUND OF THE INVENTION

The present invention relates to a control system for the selection and storage of each phonograph record side to be played in a coin-operated musical amusement machine or juke box with a storage and a credit mechanism.

A coin-operated juke box, as already known in the art, has a number of individually playable phonograph records in a magazine and a drive mechanism which lifts individual phonograph records from the magazine, places the record on a turntable, plays the record and returns the record to the magazine. The use of a record selection device, which makes it possible to select certain record sides is known in the art. It is also known how to provide a storage unit in order to store the selected record side. These control systems are basically of a mechanical or electromechanical nature, and they therefore require extensive servicing due to their wear and contact properties.

Also, control systems with magnetic core storages are already known. However, such storages involve a very cumbersome manufacturing process. In addition, there are known control systems in juke boxes, which mainly use electronic elements, diodes, transistors and integrated circuits in order to facilitate quick operation and a more economic manufacturing process. However, these systems have a relatively large susceptibility to trouble and use a large number of such electronic elements (components), so that once again the same disadvantage as with the use of magnetic cores results. Finally, there is also known a system where shift registers are used in conjunction with an auxiliary register as storage. However, such a system has the decisive disadvantage that the information stored during the read-out time of a line cannot be taken into consideration during this read-out time.

It is, therefore, an object of the present invention to provide a control system of the initially mentioned type which is as simple as possible, assures easy programmability, combined with a low susceptibility to operating trouble.

Another object of the present invention is to provide a control system of the foregoing character which has parts readily accessible for maintenance, and which has a long operating life.

A further object of the present invention is to provide a control system, as described, which may be economically fabricated.

SUMMARY OF THE INVENTION

The objects of the present invention are achieved by providing a microcomputer unit in the form of a process computer where the number of inputs and outputs are limited to a minimum. In a further embodiment of the present invention, the microcomputer unit comprises a central computer unit, a set-value storage and a write/read storage with selective access.

The advantages of the present invention are that this control system can perform all control, monitoring and computing functions inside the juke box with an economic programmability. The command structure of the control system can be changed quickly which assures high flexibility. Furthermore, it provides the possiblity of making all storages in the form of semiconductor storages and to assign them without difficulties as write/read storages with selective access by the microcomputer unit. The great flexibility of the control system allows the manufacturer of such juke boxes a fixed level converter package and associated packages, which operate in conjunction with the control system in accordance with the present invention, and may remain the same for the various types of juke boxes, while the working functions in the juke box can be changed by merely reprogramming.

Another advantage of the control system in accordance with the present invention is, that via a simple addition of a battery, the associated supply voltages can be buffered and thus the semiconductor storage, in case of line power failure, retains its storage content. In place of the battery buffering to maintain the retention of information during line power failure, it is also possible to insert a write/read storage with selective access which has the property of storing its information content for a longer period of time (approx. 6–8 months). The advantages of this control system lie in the easy programmability of the over-all system, the great flexibility, the inexpensive construction and the possibility of quickly changing over from one type of juke box to another. In addition, a high freedom from trouble for the over-all system and the juke box can easily be split up into packages (modules) which can without difficulty be combined into an overall system.

A preferred switching circuit for implementing the control system in accordance with the present invention is arranged as follows: The microcomputer unit, coupled with a clock (timing) generator, is connected via input and output lines to a BCD for 1 out of 10 decoder, to a BCD for 7-segment decoder, to a BCD for 1 out of 16 decoder and via these decoders to level converters with series-connected output units and input circuits, such as coding table, keyboard, input switch and coin switch. The level converters, for the purpose of energizing, are coupled with displays, relays and switches which have specific functions in the juke box. The BCD for the 7-segment decoder is used to energize 7-segment displays which may selectively display the position of the just playing phonograph record, the just made selection or any other additional display, such as, e.g., wrong selection or coin storage content.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
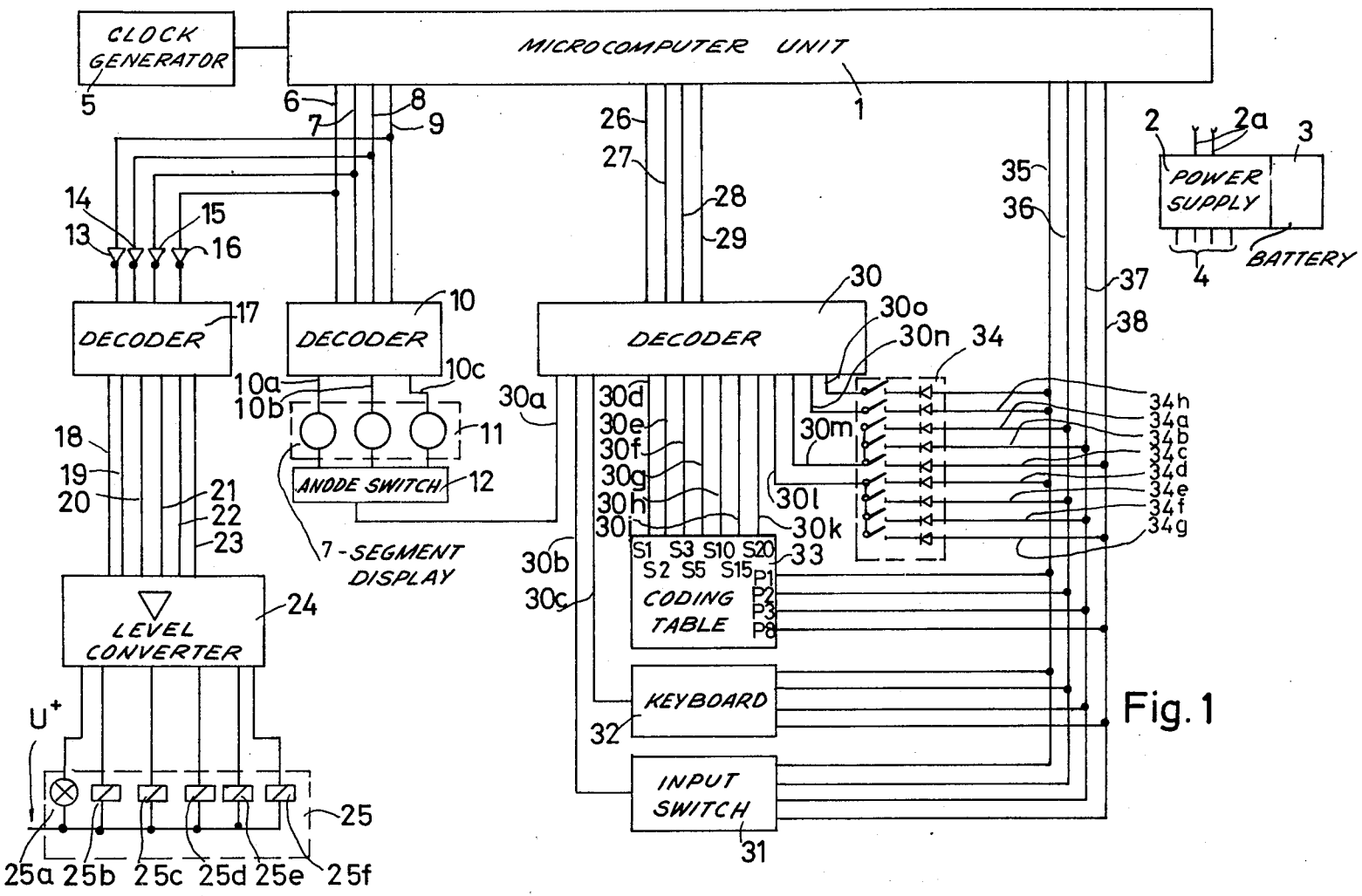
FIG. 1 is a block circuit diagram of a circuit for implementing the control system in accordance with the present invention.

The microcomputer unit 1, comprising a central computer unit, a set-value storage, a write-read (record-playback) storage with selective access and input and output lines, is supplied by power supply 2 with appropriate voltage. Storage 2 with input 2*a* (220 V/50 Hz) is buffered by battery 3 so that in case of line failure, the microcomputer unit 1 continues under power. Power supply 2 supplies the voltages required for the various units via outputs 4 to the various circuits in a known manner (not shown). Buffering of power supply 2 by means of battery 3 also is accomplished in a known manner (not shown). The clock generator 5 is used for generating a basic cycle with a basic frequency assigned to microcomputer unit 1. Microcomputer unit 1 is connected via lines 6–9 to a BCD to the 7-segment decoder 10 which is connected via associated lines 10*a*, 10*b*, 10*c* to a single-digit 7-segment display 11 which is coupled with anode switches 12. Also, lines 6–9 are connected to the inputs of inverters 13–16 whose outputs are connected with a BCD to 1 out of 10 decoder 17. The outputs of the 1 out of 10 decoder 17 lead via lines 18–23 to the level converters 24. The outputs of level converters 24 lead to output units 25. The output units 25 have the following functions characteristic for a juke box: output unit 25*a* is used to display the request: select, output unit 25*b* is used for switching between running to the left and running to the right, output unit 25*c* is used for energizing the motor for the search run of the drive mechanism, output unit 25*d* is used for initiating the process: playback, output unit 25*e* is used for changing the speed if records of different speed are to be played, output unit 25*f* is used for energizing a control counter for the installer of the juke box.

Also, the microcomputer unit 1 is connected via lines 26–28 to the BCD to 1 out of 10 decoder 30 whose outputs 30*a*–30*o* are connected to the associated series-connected units. Line 30*a* leads to the anode switches 12 which are energized (triggered) via this line, with the 7-segment displays being energized and illuminated by the multiplexing method. Outputs 30*b*–30*o* are connected to the input switches 31, the keyboard 32, the coding table 33 and the coin switch arrangement 34. The outputs of units 31–34 are connected to main lines 35–38 which as input lines lead to the microcomputer unit 1.

The control system in accordance with the present invention operates as follows:

The output signals of microcomputer unit 1 are applied via lines 6–9 to the BCD of 7-segment decoder 10 which in the BCD code contain hexadecimal information; the 7-segment decoder 10 only interprets the numbers 0–9 and passes them onto the 7-segment display 11. Numbers 10–15 are not displayed. Hence the numbers 10–15 are the redundancy for the 7-segment decoder 10. Since the redundancy can be dispensed with, numbers 10–15 are inverted as output signals via the inverters 13–16 and are used as input signals for the 1 out of 10 decoder 17. Then the six output signals of the 1 out of 10 decoder 17 energize the level converters 24 and the series-connected output units 25. Such a connection makes optimum use of the four outputs 6–9 of the microcomputer unit 1. The 7-segment display 11 is energized by the multiplex method via the anode switches 12 and line 30*a* from the BCD of 1 out of 16 decoder 30. This decoder 30 in turn is energized by the output signals of the microcomputer unit 1 via lines 26–29. The other outputs of decoder 30, namely outpus 30*b*–30*o* are also successively supplied with pulses by the multiplexing method, so that always a pulse is applied on these lines at specific times. The pulse on line 30*b* leads to input switches 31 whose number is limited to four. Hence, one or more of the associated lines 35–38 can be connected via the associated switches and by means of a program from microcomputer 1, it can be determined which switch was just closed.

Line 30*c* leads to keyboard 32 which, in addition to its key switches, contains a diode coding matrix with a number 0–15 being assigned to the associated keys; this number is delivered in the BCD code 35–38 to the microcomputer unit 1. Lines 30*d*–30*k* are used for energizing coding table 33, with outputs of the coding table 33 being applied via inputs 35–38 to microcomputer unit 1. The coding table 33 whose inputs are denoted by S1, S2, S3, S5, S10, S20, S50 and whose outputs are denoted by P1, P2, P4, P8, are used for the flexible setting of the price for a record side to be played. It offers the installer or concessionaire of the juke box the possibility to assign prices by his choice; i.e., when a certain amount of coins, e.g. DM 10. (or equivalent amounts in other currencies) — are stored in the coin storage of microcomputer 1, the installer, by connecting input S100 of coding table 33 via diodes with outputs P1-P8 of this coding table 33, can establish that for these DM 10. — 15 playbacks (record sides) are made. For example, the installer, by connecting S1 to outputs P1-P8 via diodes can assign 15 playbacks to a single DM and accordingly would permit 150 playbacks for DM 10.— Outputs 30 1–30*o* are used for energizing coin switch 34. Switches 34*a*–34*g* are assigned the values 1, 2, 5, 10, 20, 50, 100, the switch 34*h* has the value: permanent credit and the switch 34*i* is assigned the possibility whether to convert money into units of playback or an indirect money conversion in units of playback. With the direct money conversion, the applied introduced coin value would be converted directly via the coding table and with the indirect money conversion, the money value would be converted into units of playback only upon actuating a key of keyboard 32 via coding table 33. Thus it is possible to arbitrarily assign a bonus or rebate to the coin or money value.

In further explanation of the control system in accordance with the present invention, the following describes the function flow chart of a juke box; the initial condition is that the juke box is ready for playback, but without current supply. After connecting the juke box to the line power supply, the program starts. In block 100, the switch-on condition for the microcomputer unit 1 and all series-connected and assigned amplifiers and input lines is set. At the same time, a holding circuit sees to it that the program does not start before the buildup of the supply voltages. In block 101 it is checked whether the battery for buffering the line power supply was connected before the juke box was connected and whether, therefore, the program must start at the point: battery test, or whether the program must start at point 0. Block 102 causes the running through of amplifier subroutine VUP, block 103 causes the running through of control counter subroutine KUP, block 104 causes the running through of selection subroutine WUP, block 105 causes the running through the coin and money subroutine GUP, and block 106 determines what position display PAZ takes effect, —whether after block 107 the position of the just played record side or whether after block 108 the selection of the just made selection of the desired record side is displayed. With block 109, the search-run subroutine SUP is run through, and then the loop to block 101 is closed in order to check whether still the line supply or already the battery is in operation and, with the battery connected and the line supply turned off, to keep the program at a point so as to obtain a certain switch-on status.

The subroutines mentioned in conjunction with the preceding master routine, are now explained in detail.

Figure 2:
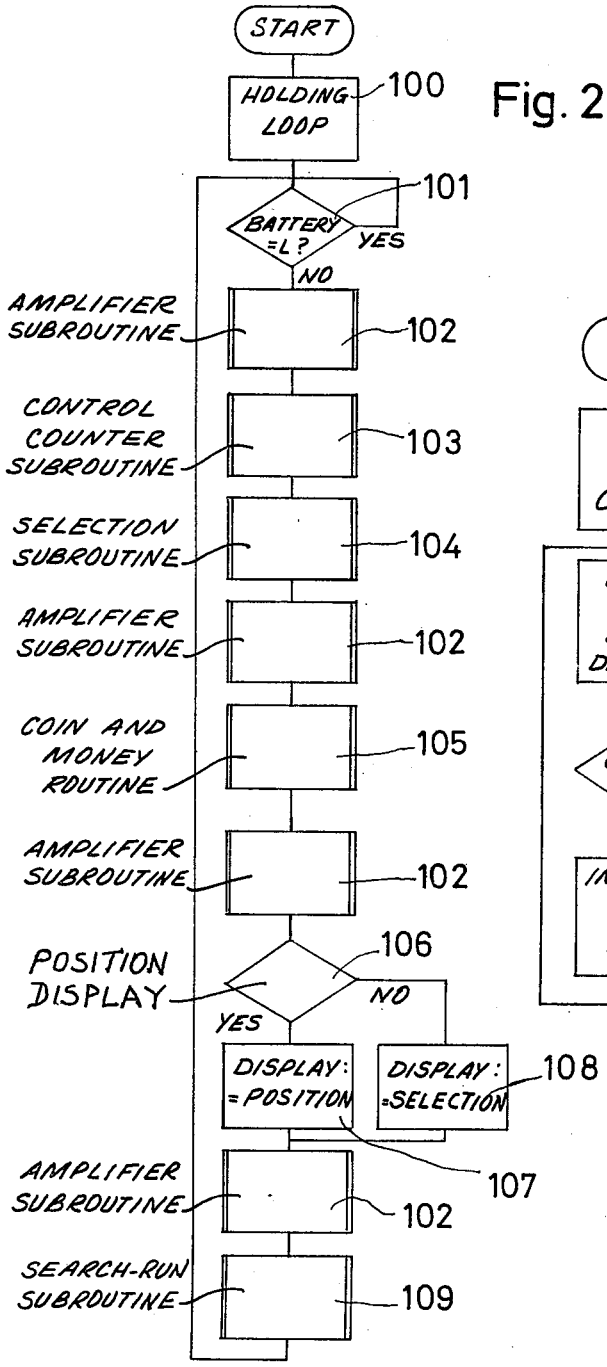
FIG. 2, 2*a*, 2*b*, 2*ca*, 2*cb*, 2*cc*, 2*d* show the function flow chart of a juke box with a microcomputer unit, according to the present invention.
Figure 2A:
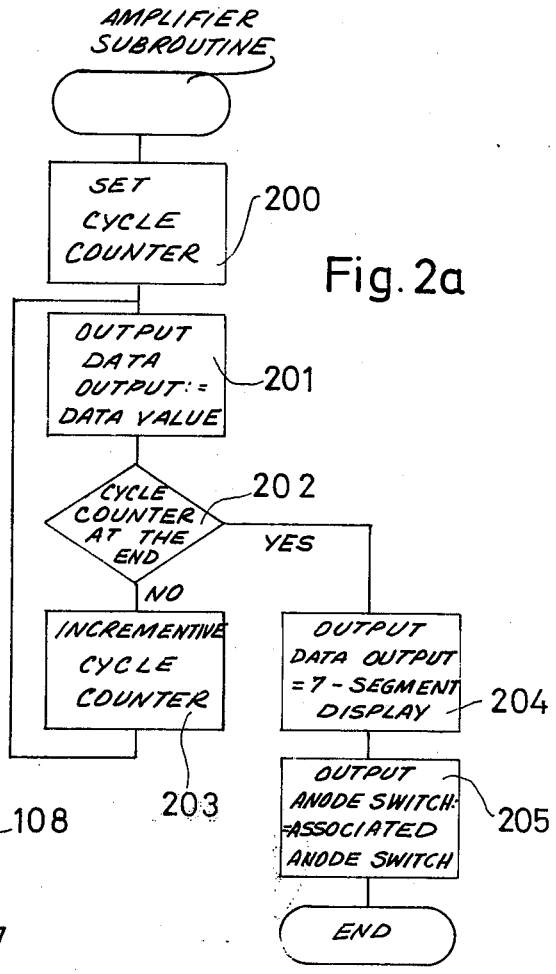

The amplifier subroutine VUP consists of blocks 200–205 (FIG. 2*a*). According to FIG. 1, the amplifier outputs are provided in BCD code; these are numbers 10–15. A cycle counter in accordance with block 200 is set to number 6 and the associated data words are applied successively to the outputs by the multiplexing method. According to block 201, the cycle counter is interrogated, and according to block 202 the cycle counter is interrogated whether it is finished. If this is not the case, the cycle counter is incremented in accordance with block 203 and a new data word is given out. If the cycle counter according to block 202 is finished, then according to block 204 the data word for the 7-segment display is placed at outputs 6, 7, 8, 9 and the 7-segment decoder 10 is energized. At the same time, via outputs 26–29 according to block 205, the associated anode switch is activated via the 1 out of 16 decoder 30 and the associated line 30*a*. This type of multiplexing connection is possible when the run of the master loop is in the millisecond area and the level converter 24 are, e.g., thyristors operating with a rectified but unfiltered bridge voltage and thus remain connected for the remainder of the half-wave after connection. With suitably set times, the repetition frequencies are so high that the output units 25 series-connected with the level converters remain continuously connected, if an associated 1-signal is applied, or, respectively, the 7-segment displays flicker.

The selection subroutine WUP according to block 104 consists of blocks 300–309 (FIG. 2*b*). According to block 3, in the write-read (record-playback) storage the storage location for: Select must be interrogated for one with selective access by the microcomputer unit 1. If this storage location is vacant, the entire select process is circumvented and a key selection is not possible. If this storage location is not vacant, a keyboard input according to block 301 is possible; as anti-bounce (anti-chatter) circuit, a suitable 01-identification with associated time circuit is added; this can be accomplished by the program (routine). According to block 302, inquiry is made whether the first digit had already been selected, according to block 303, whether the second digit had already been selected, according to block 304, whether the third digit, or key A or B had already been selected. It is customary with juke boxes to make the selection of the desired record side by means of a key input via three digits or via two digits and an associated letter, or via one digit and an associated letter. The program must be written accordingly. In the case here, the selection of the record side is made via two digits and the letters A and B. If according to block 302 the first digit has already been put in, in entered key selection according to block 301 is the second digit. If according to block 303 the second digit has already been selected, the entered key selection is key A or B. This concludes the input of the phonograph record to be selected, including the record side; in the write-read storage for selective access, the corresponding bit location assigned to this digit/letter combination is set according to block 305. In the control system, in accordance with the present invention, not the entered digit sequence is stored, but a well defined bit location is set, which, when it is read again, represents the position which had previously been selected. After the bit location has been written, a play is subtracted according to block 306 from the play storage located in the write/-read storage with selective access. Inquiry is made via block 307 whether the play storage is greater than or equal to 0; then the information: Select is set in the write/read storage with selective access according to block 309. If the play storage is not equal to zero, the information: Select is set equal to 1 according to block 308 and during the next work cycle a renewed key input can be made by the program.

Figures 2C, 2D:
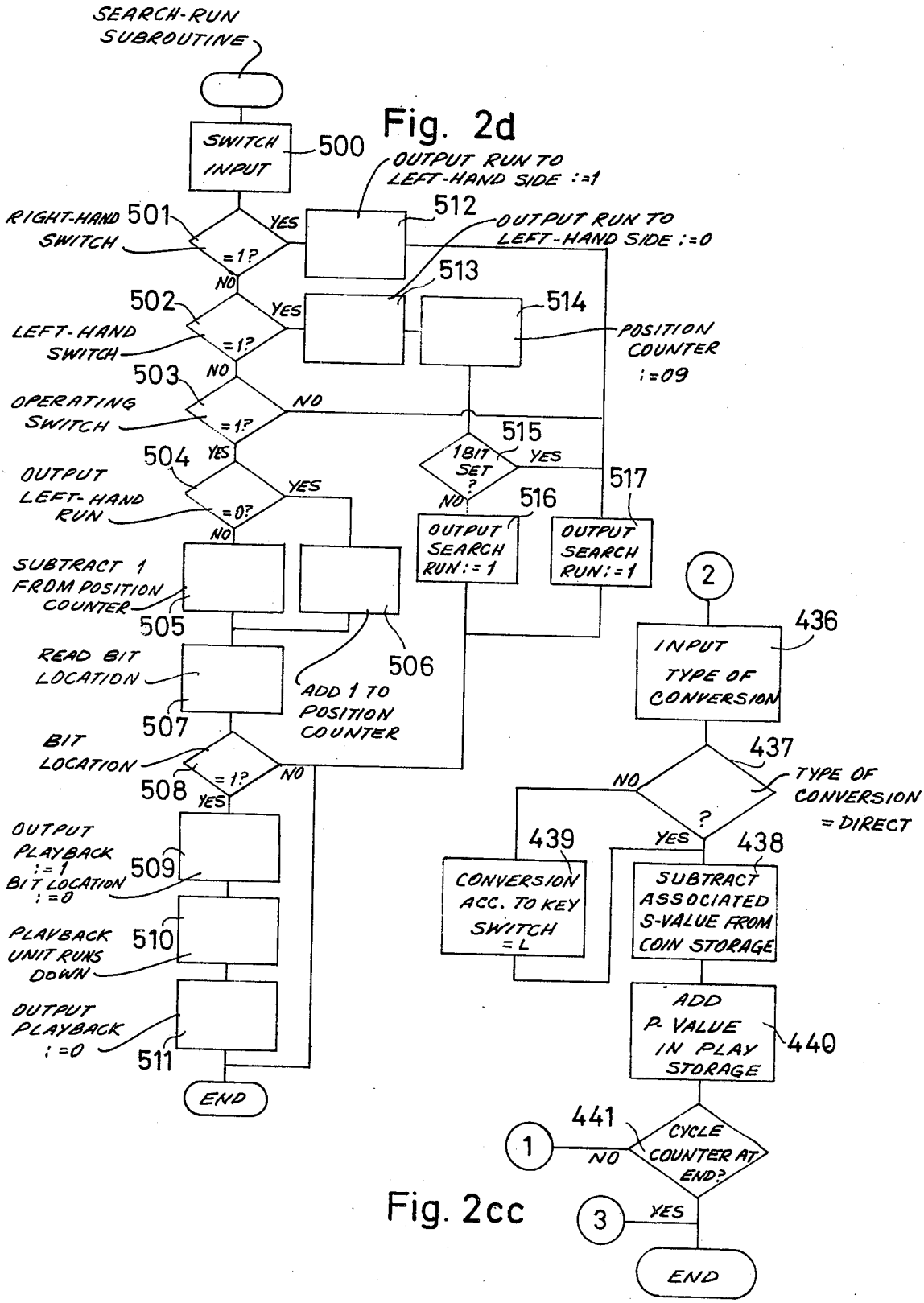
Figure 2C:
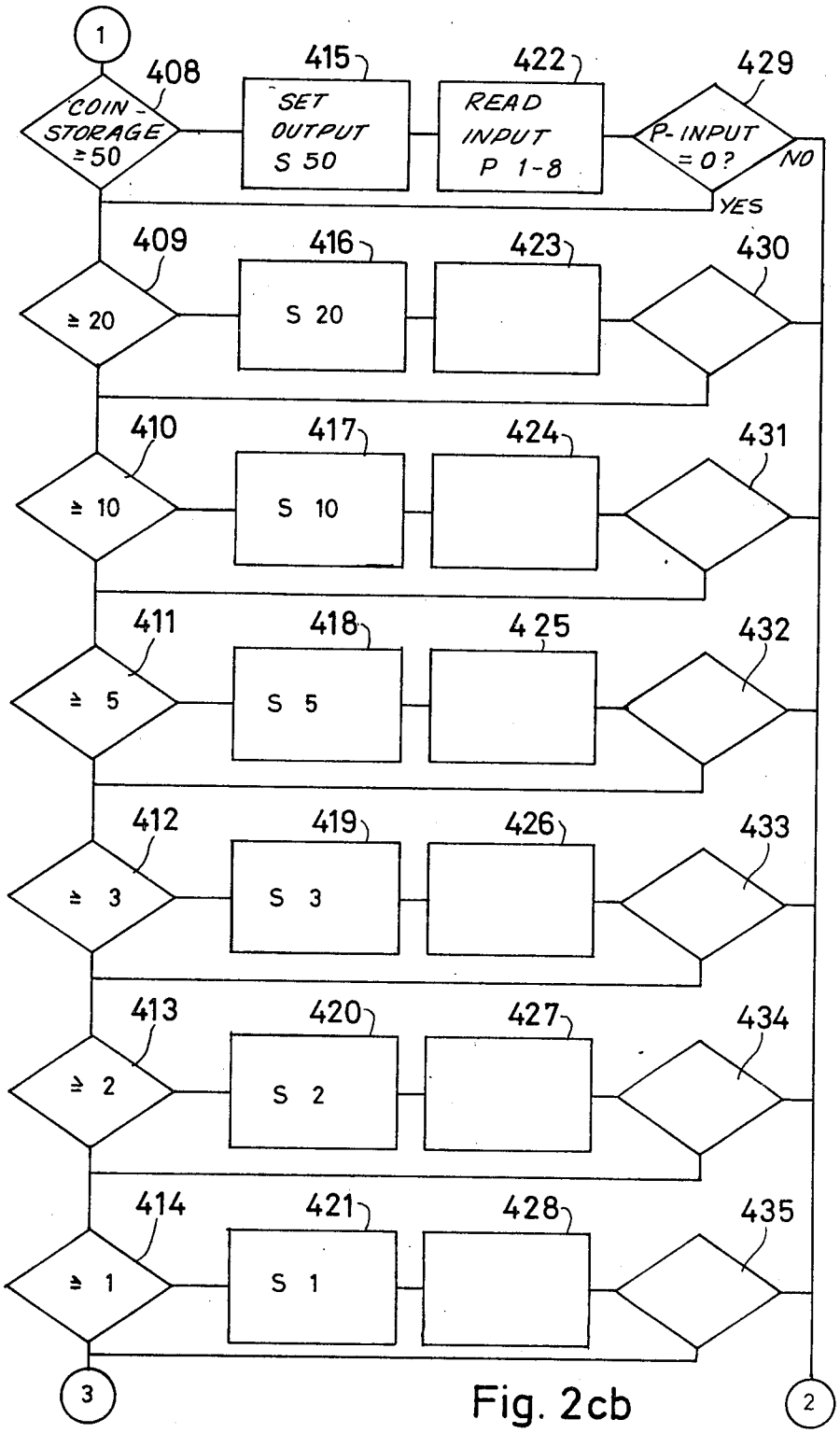

The coin and money subroutine GUP according to block 105 in the master routine is denoted by blocks 400–441 (FIG. 1*ca*, FIG. 2*cb*, FIG. 2*cc*). This subroutine is divided into two main groups: the main group for the coin acceptance and coin storage and the main group for converting the coin storage content into playback units and the storing of playback units in the play storage. According to block 400 a cycle counter is set which permits the scanning of the coin switches 34 (FIG. 1) by the multiiplexing method. For this purpose, the microcomputer unit 1 emits signals via line 26–29 and the BCD to the 1 out of 16 decoder 30 with the outputs 30 1–30*o* according to block 401; these signals are then applied via switches 34 and lines 35–38 to the microcomputer unit 1. The assignment of definite weights to the switches permits direct addition of the incoming value in the coin storages according to block 402. In this embodiment, the switches have been assigned weights 1, 2, 5, 10, 20, 50, 100, i.e., if the lowest denomination coin is assumed to be DM 0.10, the following coin values may correspond to the values resulting from the lowest-denomination coins multiplied by the weight. According to block 403, the cycle counter is interrogated whether it is near the end (finished). If the cycle counter is not run out (finished), it is incremented and the next coin value can be accepted. If the cycle counter then is at the end, the program leads from block 403 to block 405. This gives the installer of owner of the juke box the possibility to provide, instead of a coin, a permanent credit via blocks 404, 406, 407. This permanent credit is directly added to the play storage, without passing through the coin storage. In this example the value 10 is used as that value.

After feeding the coins into the coin storage (receptacle), the coin storage contents must be converted into units of playback. According to FIG. 1, the coding table 33 is used for this purpose. By means of this table, the installer or owner can undertake the conversion of coin units into units of playback freely within the scope of given possibilities, which numerically have been chosen for this embodiment, but may also accept other number combinations. The conversion proceeds as follows: the clin storage is interrogated for the highest value to be converted, in our example this is the value 50. If the contents of the coin storage is greater than 50, the corresponding output is set via lines 26–29 and the decoder 30 and the line 30*k*. Then the output P1–P8 of coding table 33 is interrogated and the value is communicated via lines 35–38 of the microcomputer unit 1. If the installer has selected conversion according to the weight of S50 at P1–P8, the input of the conversion type according to block 436 is actuated. If according to block 437 a direct conversion is possible, the value 50 is directly subtracted from the coin storage according to block 438, and the associated P-value, in this case 15, is added to the play storage according to block 440. Then the end of the cycle counter is interrogated with block 441. If this end is reached, the program continues according to the master routine; if the end is not reached the program reverts back to the interrogation block 408 and again interrogates the coin storage for its highest valence. The process via blocks 408, 415, 422 and 429 repeats itself. If, in this case, the P-input is, e.g., zero, the coin storage is interrogated for its next higher weight, namely 20. Then the process repeats itself similar to that with blocks 408, 415, 422, 429 and also in blocks 409, 416, 423, 430 and then reaches conversion via the connection point 2 to block 436 or to once more interrogate the next weight via the zero decision of the P-input. If the coin storage is empty, its weight is nevertheless interrogated; but since its content is below the lowest weight, the conversion, both the direct and the indirect one, is bypassed.

According to block 109 of the master routine, the search program SUP with block 500–517 is interrogated (FIG. 2*d*). The search subroutine fundamentally has the task of searching for a read-in bit location; the drive mechanism with the playback device of the juke box runs to the desired phonograph record, takes it out, plays it, puts it away again and, when a next (subsequent) bit location is set, runs to this bit location and there repeats the process. It should be noted that the drive mechanism is switched at its extreme right-hand position, e.g., from running to the right to running to the left, or from running to the left to running to the right, that the run of the drive mechanism is counted via a position counter and that the contents of this position counter are displayed via the 7-segment display. The stopping of the drive mechanism at its extreme right or lefthand position is reported to the microcomputer unit 1 via the input switches 31. If, with the juke box not connected, the drive mechanism is placed at a random location, this is reported via the drive mechanism switch and via the input switch 31 to the microcomputer unit 1, and when the juke box is turned on, the drive mechanism runs to its initial position.

In detail, the search subroutine proceeds as follows: According to block 500, the input switches 31 are offered via lines 35–38 to the microcomputer unit 1. If the right-hand switch is not closed, but the left-hand switch according to block 502, the output left-hand run is set to 0 according to block 513, and the position counter, depending on the peculiarity of the juke box used here, is according to block 514 set to position 09. If a bit in the write/read storage with selective access by the microcomputer unit 1 is set to one, according to block 517 the output search-run is set to 1 and the associated output unit 25 is connected. If according to block 515 no bit has been set, the output: Search according to block 516 is switched to 0 and hence the drive mechanism remains in its initial position at the left-hand switch. According to blocks 504–506, the running drive mechanism is scanned with a pluse switch and a pulse is applied to the write/read storage with selective access after every step of the drive mechanism. This pulse application also proceeds via the input switches 31 and via lines 35–38 which are energized by lines 26–29 via decoder 30. At the same time, the associated bit location is read according to block 507. If this bit location is a 1, the output: playback is set to 1 and the associated bit location is changed to 0. After playback, the output: playback is automatically reset to 0. If the associated bit location according to block 508 was not set at one, the program runs to the end of the search run.

The above-mentioned individual subroutines, depending on the play system, can be coordinated with one another and optimum function flow can be achieved by meaningful arrangement of the control system. Of course, at the same time, changes can be very quickly incorporated in the program, so that changes in the over-all system are to be introduced only via the program.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

We claim:

1. A control system for the selection and storage of each phonograph record side to be played in a coin-operated juke box having storage and credit means comprising a microcomputer unit operating as a process computer, said computer having a number of inputs and outputs limited to a minimum by series-type runs; a switching circuit comprising a timing generator connected to said microcomputer, a BCD for 1 out of 10 decoder connected to said microcomputer, a BCD for 7-segment decoder connected to said microcomputer, a BCD for 1 out of 16 decoder connected to said microcomputer, level converting means with series connected output units and input circuits and connected to said microcomputer through said decoders, said series connected output units and input circuits comprising coding means, keyboard means, input switch means and coin switch means.

2. The control system as defined in claim 1 wherein said level converting means are connected to display means, relay means and switch means.

3. The control system as defined in claim 1 including battery means for buffering said timing generator and said microcomputer to avoid loss of information.

4. The control system as defined in claim 1 including a write/read storage with selective access for storing information during a substantially long period of time, said timing generator and said microcomputer being buffered by said write/read storage to avoid loss of information.

5. A control system for the selection and storage of each phonograph record side to be played in a coin-operated juke box having storage and credit means comprising a microcomputer unit operating as a process computer, said computer having a number of inputs and outputs limited to a minimum by series-type runs, said microcomputer comprising a central computer unit, a set-value storage, and a write/read storage with selective access; switching circuit means comprising a clock generator connected to said microcomputer, a BCD for 1 out of 10 decoder connected to said microcomputer, a BCD for 7-segment decoder connected to said microcomputer, a BCD for 1 out of 16 decoder connected to said microcomputer, level converters with series-connected output units and input circuits connected to said microcomputer through said decoders, said series-connected output units and input circuits comprising coding means, keyboard means, input switch means and coin switch means, said level converters being connected to display means, relay means and switch means, battery means, said timing generator and said microcomputer being buffered by said battery means to avoid loss of information.

6. A control system for the selection and storage of each phonograph record side to be played in a coin-operated juke box having storage and credit means comprising a microcomputer unit operating as a process computer, said computer having a number of inputs and outputs limited to a minimum by series-type runs, said microcomputer comprising a central computer unit, a set-value storage, and a write/read storage with selective access; switching means comprising a timing generator connected to said microcomputer, a BCD for 1 out of 10 decoder means connected to said microcomputer, a BCD for 7-segment decoder means, a BCD for 1 out of 16 decoder means, level converters with series-connected output means and input circuits connected to said microcomputer through said decoder means, said series-connected output means and input circuits comprising coding means, keyboard means, input switch means and coin switch means, said level converters being connected to display means, relay means and switch means, and write/read storage means with selective access for storing information for a substantially long period of time, said microcomputer and said timing generator being buffered by said write/read storage means to avoid loss of information.

* * * * *